US007954346B2

(12) United States Patent
Zorzolo

(10) Patent No.: US 7,954,346 B2
(45) Date of Patent: Jun. 7, 2011

(54) CUTTING MACHINE PARTICULARY FOR LEATHER AND SIMILAR MATERIALS

(75) Inventor: Stefano Zorzolo, Vigevano (IT)

(73) Assignee: Comelz S.p.A., Vigevano (IT)

( * ) Notice: Subject to any disclaimer, the term of this patent is extended or adjusted under 35 U.S.C. 154(b) by 0 days.

(21) Appl. No.: 12/451,061

(22) PCT Filed: Apr. 28, 2008

(86) PCT No.: PCT/EP2008/055188

§ 371 (c)(1),
(2), (4) Date: Oct. 23, 2009

(87) PCT Pub. No.: WO2008/135437

PCT Pub. Date: Nov. 13, 2008

(65) Prior Publication Data

US 2010/0089103 A1 Apr. 15, 2010

(30) Foreign Application Priority Data

May 2, 2007 (IT) ..... MI2007A0880

(51) Int. Cl.
*C14B 1/00* (2006.01)

(52) U.S. Cl. ..... 69/2; 69/21

(58) Field of Classification Search ..... 69/2, 21
See application file for complete search history.

(56) References Cited

U.S. PATENT DOCUMENTS

| | | | | |
|---|---|---|---|---|
| 5,172,326 | A | 12/1992 | Campbell, Jr. | |
| 5,777,880 | A | 7/1998 | Bowen et al. | |
| 6,283,001 | B1 * | 9/2001 | Schultes | 83/39 |
| 6,434,444 | B2 * | 8/2002 | Herman, Jr. | 700/135 |
| 6,856,843 | B1 * | 2/2005 | Herman, Jr. | 700/95 |
| 7,093,990 | B2 * | 8/2006 | Berdan, II | 400/76 |
| 7,154,530 | B2 * | 12/2006 | Andrews et al. | 348/86 |
| 2002/0002416 | A1 | 1/2002 | Herman, Jr. | |

FOREIGN PATENT DOCUMENTS

| | | |
|---|---|---|
| DE | 35 19 806 A1 | 8/1986 |
| EP | 1 157 793 A | 11/2001 |

* cited by examiner

*Primary Examiner* — Shaun R Hurley
(74) *Attorney, Agent, or Firm* — Modiano & Associati; Albert Josif; Daniel O'Byrne

(57) ABSTRACT

A cutting machine, particularly for leather and similar materials, comprising a cutting area provided with one or more cutting heads and with an area for unloading the cut parts, the areas being arranged along a conveyor belt, material detection means being provided in order to detect the position of the material before cutting it, the machine further comprising a detection area, arranged upstream of the cutting area, the material detection means being arranged in the detection area in order to detect the position of references provided on the material to be cut.

1 Claim, 2 Drawing Sheets

CUTTING MACHINE PARTICULARY FOR LEATHER AND SIMILAR MATERIALS

The present invention relates to a cutting machine, particularly for leather and similar materials, with a section for detecting the material to be cut.

BACKGROUND OF THE INVENTION

As is known, in cutting machines for leather and similar materials, which have a cutting area with one or more cutting heads and an area for unloading cut parts, arranged along a conveyor belt, it is often desirable to cut parts in an aligned manner, with a precision on the order of tenths of a millimeter on materials printed with references and logos.

In view of the limited rigidity of the printed material, it is not possible to calculate in advance the exact position of the parts to be cut, but it is necessary to readjust a theoretical position calculated beforehand according to the actual position of the references of the material arranged in the cutting area.

For this purpose, TV cameras are used which detect the exact position of the references printed on the material to be cut, in order to readjust the position of the parts before cutting them. This operation is normally performed when the material is already positioned in the cutting area, by using a TV camera which is mounted on the same carriage that supports the cutting head, which views sequentially limited portions of the material arranged on the cutting area.

After this operation, the control processes the information to readjust the position of the parts to be cut.

Substantially, an operation for cutting leather or similar material is preceded by a step for loading the material onto the cutting area, a step for detecting the exact configuration of the references provided on the material to be cut, and a step for processing the information in order to readjust the position of the parts to be cut.

However, the known types of cutting machines described above suffer the drawback of having to perform the three operations cited above before being able to proceed with the cutting of the material.

This of course entails an expenditure of time.

Moreover, with known types of systems it is not possible to perform in parallel the detection and processing operations and the cutting operations.

SUMMARY OF THE INVENTION

The aim of the present invention is to provide a cutting machine, particularly for leather and similar materials, which allows to perform in parallel the operations for detecting/processing the cutting data and the cutting operations, to the advantage of productivity.

Within this aim, an object of the present invention is to provide a cutting machine, particularly for leather and similar materials, which allows to cut the material with the assurance that its position on the conveyor belt conforms with the position detected during the material detection step.

Another object of the present invention is to provide a cutting machine, particularly for leather and similar materials, which allows to take into account any material positioning errors caused by the advancement of the belt, once the material has been detected by the TV camera system.

Still another object of the present invention is to provide a cutting machine, particularly for leather and similar materials, which is highly reliable, relatively simple to provide and at competitive costs.

This aim and these and other objects, which will become better apparent hereinafter, are achieved by a cutting machine, particularly for leather and similar materials, comprising a cutting area provided with one or more cutting heads and with an area for unloading the cut parts, said areas being arranged along a conveyor belt, material detection means being provided in order to detect the position of the material before cutting it, characterized in that it comprises a detection area, arranged upstream of said cutting area, said material detection means being arranged in said detection area in order to detect the position of references provided on the material to be cut.

BRIEF DESCRIPTION OF THE DRAWINGS

Further characteristics and advantages of the invention will become better apparent from the description of a preferred but not exclusive embodiment of the machine according to the invention, illustrated by way of non-limiting example in the accompanying drawings, wherein.

DESCRIPTION OF THE PREFERRED EMBODIMENTS

Figure 1:
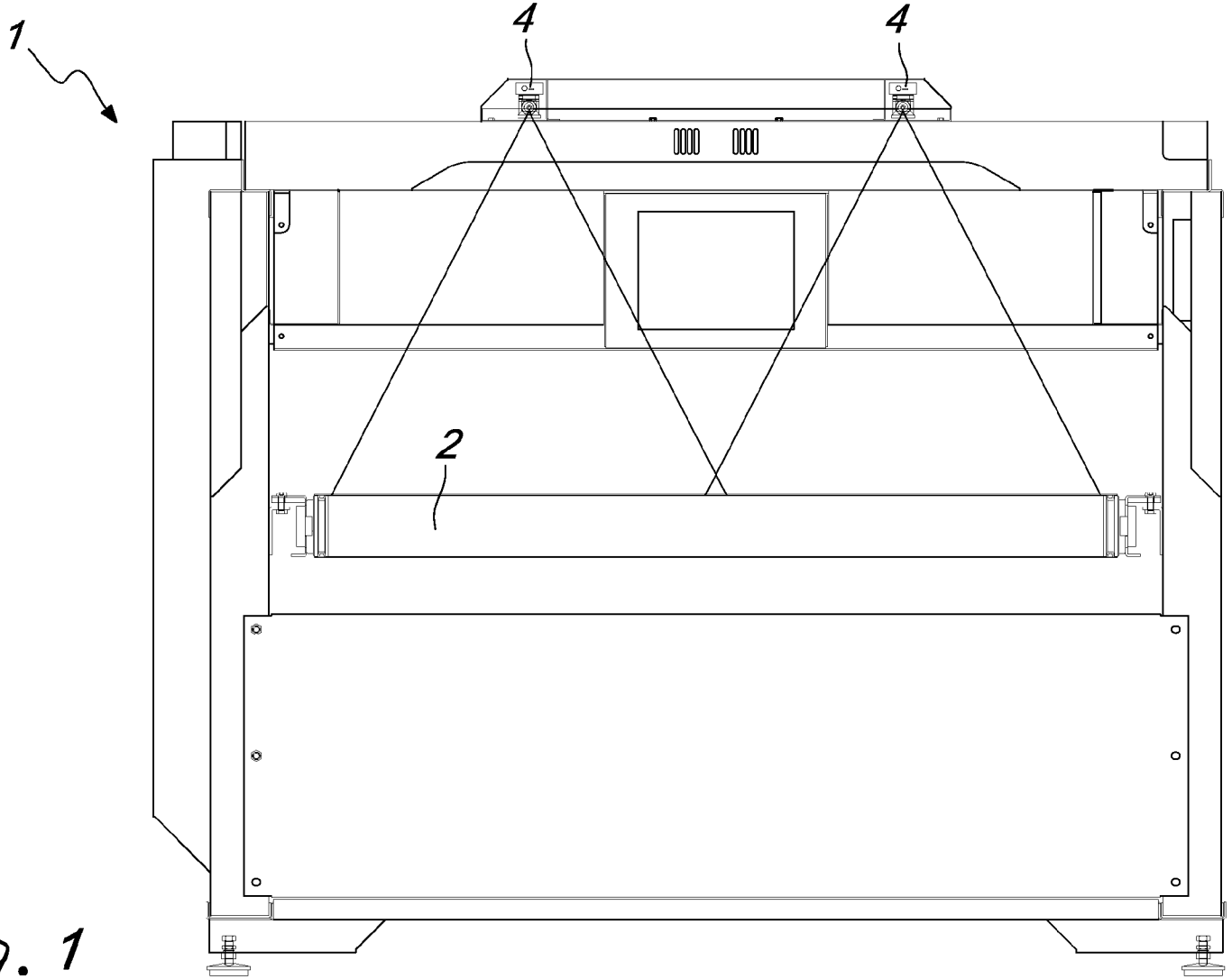
FIG. 1 is a front elevation view of the machine according to the present invention.
Figure 2:
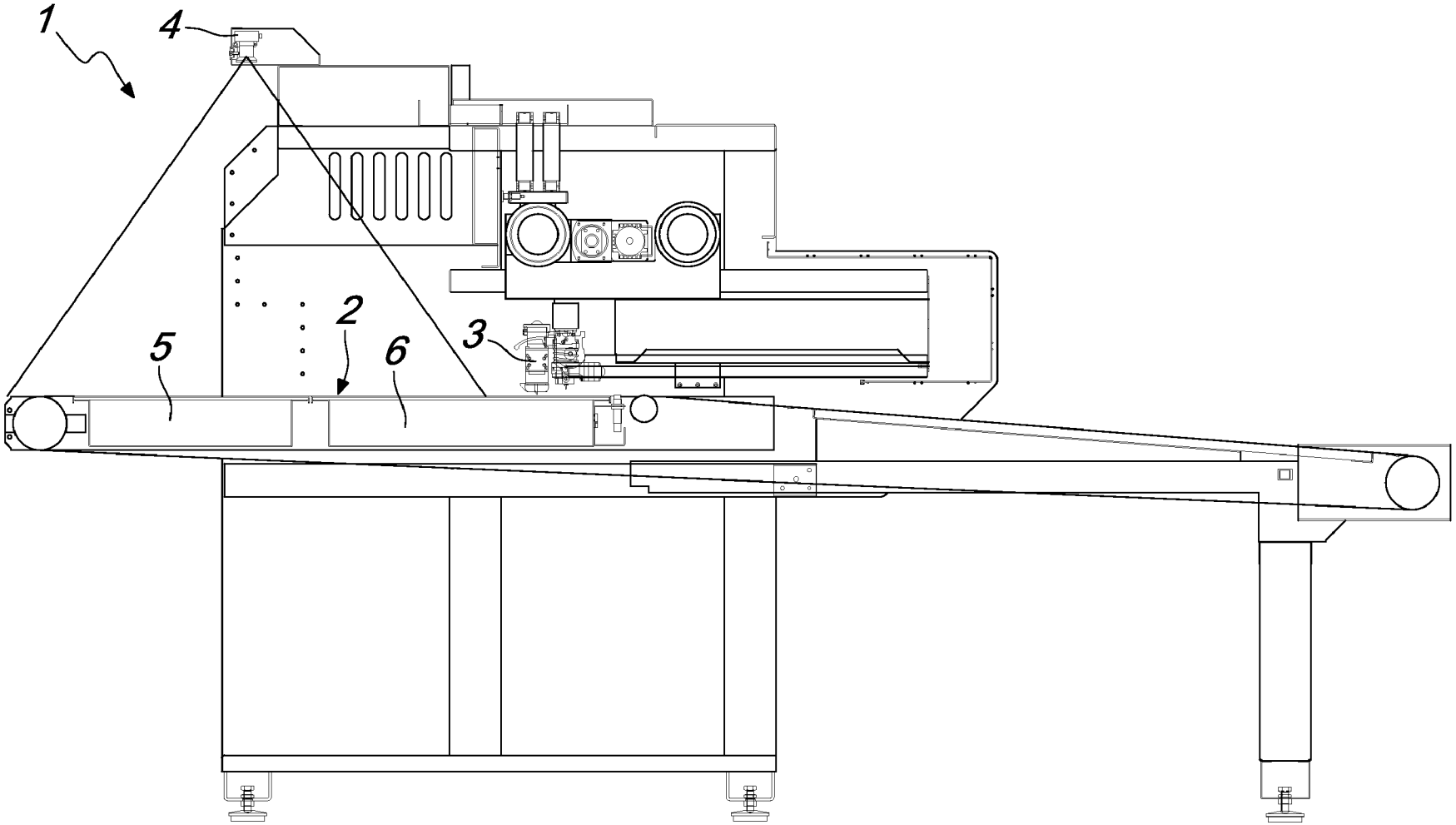
FIG. 2 is a side elevation view of the machine according to the present invention.

With reference to the figures, the cutting machine according to the present invention, generally designated by the reference numeral 1, comprises a conveyor belt 2, on which the material to be cut is arranged, and one or more cutting heads 3 arranged above the conveyor belt, the belt moving along the longitudinal extension of the machine.

One or more material detection means, such as TV cameras 4 are provided in order to detect the position of the material on the belt; the position of the parts is not detected but is entered by the machine taking into account the position of the references, thus detecting the exact layout of the references provided on the material.

Conveniently, the TV cameras 4 are provided at a detection area 5 which is arranged upstream of a cutting area 6. In the detection area 5, the one or more TV cameras 4 detect the exact layout with references provided on the material, so as to be able to perform in parallel the detection/processing operations, when the material is at the detection area 5, and the cutting operations with the material already located at the cutting area 6.

While the detection/processing operation for readjusting the position of the parts to be cut (so-called nesting) is performed in the detection area 5, at the cutting area 6 it is already possible to cut the portion of material viewed and adjusted previously that the conveyor belt 2 has repositioned correctly.

The precision of the positioning of the conveyor belt 2 is generally lower than the precision required to cut the parts on the printed material. Therefore, the portion of material whose exact position has been calculated in the detection area 5 might then be repositioned in the cutting area 6 with a precision which is lower than the precision required for the alignment of the parts on the references.

In order to correct the drawback cited above, the detection area 5 conveniently is larger than, and is partially superimposed on, the cutting area 6, so as to perform movements of the belt equal to the cutting area but smaller than the detection area.

This allows, at each detection, to perform a comparison between the position of the references provided on a same portion of the area, before and after the movement of the belt 2, and accordingly to recalculate the exact movement of the belt 2, thus compensating for its limited precision.

The characteristics cited above apply not only to synthetic materials, in which nesting can be calculated automatically beforehand (if the dimensions of the material are known), but also to natural leather of irregular shape which are, however, printed with references or logos, in which nesting is conveniently performed manually by projecting the outlines.

In this case, the manual placement of the outlines might be constrained by the printed references.

Substantially, the cutting machine according to the invention allows to speed up the cutting operation, since the detection and cutting operations can be performed simultaneously, detecting one portion of the material and simultaneously cutting the portion that has already been detected.

Moreover, by making the detection area larger than the cutting area and partially superimposed thereon it is possible to make a comparison between the position of the references provided on a same portion of the area before and after the movement of the belt and therefore to be able to recalculate the exact displacement of the belt, compensating for the limited precision that the belt can have in its movement.

In practice it has been found that the machine according to the invention fully achieves the intended aim and objects.

Another advantage that can be achieved with the machine according to the invention can be observed if it is necessary to perform a so-called "retrimming" operation. This operation becomes necessary when it is necessary to trim the edges of parts previously cut and coupled in layers of different materials by sewing or adhesive bonding.

By using the machine according to the present invention it is possible to arrange in the detection area, manually or by means of an automatic loader, the blank parts that must be subjected to a retrimming operation. It is therefore possible to perform the step for detection and calculation of the position of the "clean" contours, i.e., the contours that one wishes to obtain from retrimming, arranged within the rough contours of the part, move the belt toward the cutting area, and proceed with cutting and detection in parallel.

Substantially, the rough contour of the part in this case is interpreted as a "reference" for positioning the part to be cut (retrimmed).

The machine thus conceived is susceptible of numerous modifications and variations, all of which are within the scope of the appended claims; all the details may further be replaced with other technically equivalent elements.

In practice, the materials used, as well as the dimensions and the contingent shapes, may be any according to requirements and to the state of the art.

The disclosures in Italian Patent Application no. MI2007A000880, from which this application claims priority, are incorporated herein by reference.

The invention claimed is:

1. A cutting method for leather and similar materials, comprising the steps of:

arranging the material to be cut at a detection area of the cutting machine, said detection area being arranged upstream of a cutting area;

detecting the position of references provided on said material;

simultaneously with the detection operation, performing a cutting operation at said cutting area, for cutting material whose references have been detected beforehand in the detection area; wherein at each detection step, a step for comparison between the position of the references provided on the same portion of area before and after the movement of the conveyor belt is carried out, in order to be able to recalculate the exact movement of the belt, compensating for any errors of said belt.

* * * * *